US008985227B2

(12) United States Patent
Nikiforuk

(10) Patent No.: US 8,985,227 B2
(45) Date of Patent: Mar. 24, 2015

(54) DAMPERED DROP PLUG

(75) Inventor: Kevin James Nikiforuk, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 298 days.

(21) Appl. No.: 12/987,222

(22) Filed: Jan. 10, 2011

(65) Prior Publication Data

US 2012/0175133 A1 Jul. 12, 2012

(51) Int. Cl.

| | |
|---|---|
| ***E21B 33/10*** | (2006.01) |
| ***E21B 34/14*** | (2006.01) |
| ***E21B 33/16*** | (2006.01) |

(52) U.S. Cl.

CPC ..... *E21B 34/14* (2013.01); *E21B 33/16* (2013.01)

USPC ..... 166/386; 166/192; 166/193; 166/194; 166/374

(58) Field of Classification Search

USPC ..... 166/386, 192, 193, 194, 374, 156, 166/177.3, 143

See application file for complete search history.

(56) References Cited

U.S. PATENT DOCUMENTS

| | | | | |
|---|---|---|---|---|
| 3,163,238 | A | 12/1964 | Malott | |
| 5,074,366 | A | 12/1991 | Karlsson et al. | |
| 5,425,423 | A | 6/1995 | Dobson et al. | |
| 5,497,840 | A | 3/1996 | Hudson | |
| 5,957,225 | A | 9/1999 | Sinor | |
| 6,095,261 | A | 8/2000 | Trevino, Jr. | |
| 6,138,774 | A | 10/2000 | Bourgoyne, Jr. et al. | |
| 6,412,574 | B1 | 7/2002 | Wardley et al. | |
| 6,543,552 | B1 | 4/2003 | Metcalfe et al. | |
| 6,739,398 | B1 | 5/2004 | Yokley et al. | |
| 6,742,606 | B2 | 6/2004 | Metcalfe et al. | |
| 6,848,511 | B1 * | 2/2005 | Jones et al. | 166/386 |
| 6,854,533 | B2 | 2/2005 | Galloway et al. | |
| 6,857,487 | B2 | 2/2005 | Galloway et al. | |
| 6,899,186 | B2 | 5/2005 | Galloway et al. | |
| 7,013,997 | B2 | 3/2006 | Vail, III | |
| 7,036,610 | B1 | 5/2006 | Vail, III | |
| 7,040,420 | B2 | 5/2006 | Vail, III | |
| 7,048,050 | B2 | 5/2006 | Vail, III et al. | |
| 7,083,005 | B2 | 8/2006 | Galloway et al. | |

(Continued)

FOREIGN PATENT DOCUMENTS

| | | |
|---|---|---|
| CA | 2538196 | 8/2006 |
| WO | WO0194738 | 12/2001 |
| WO | WO2007/011906 A1 | 1/2007 |

OTHER PUBLICATIONS

U.S. Appl. No. 13/007,416, filed Jan. 14, 2011.

(Continued)

*Primary Examiner* — Cathleen Hutchins
*Assistant Examiner* — Taras P Bemko
(74) *Attorney, Agent, or Firm* — Osha · Liang LLP

(57) ABSTRACT

A dampered drop plug drops down a bore of a drill string. The dampered drop plug includes a retainer configured to land on an upward facing shoulder of a tubular sleeve, and a plug releasably coupled to the retainer. The plug couples to the retainer while at a first pressure in the bore and decouples from the retainer at a second pressure in the bore. The dampered drop plug lands on the upward facing shoulder of a tubular sleeve and actuates a first function. The plug then releases from the retainer, and passes fluid through the retainer at a controlled flowrate. The plug then lands on a ball seat and actuates a second function.

10 Claims, 10 Drawing Sheets

(56) References Cited

U.S. PATENT DOCUMENTS

| | | | | |
|---|---|---|---|---|
| 7,093,675 | B2 | 8/2006 | Pia | |
| 7,100,710 | B2 | 9/2006 | Vail, III | |
| 7,108,080 | B2 | 9/2006 | Tessari et al. | |
| 7,108,083 | B2 | 9/2006 | Simonds et al. | |
| 7,108,084 | B2 | 9/2006 | Vail, III | |
| 7,117,957 | B2 | 10/2006 | Metcalfe et al. | |
| 7,147,068 | B2 | 12/2006 | Vail, III | |
| 7,165,634 | B2 | 1/2007 | Vail, III | |
| 7,225,880 | B2 | 6/2007 | Braddick | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,334,650 | B2 | 2/2008 | Giroux et al. | |
| 7,360,594 | B2 | 4/2008 | Giroux | |
| 7,647,990 | B2 | 1/2010 | Tessari et al. | |
| 7,784,552 | B2 | 8/2010 | Brouse | |
| 2001/0017210 | A1 | 8/2001 | Howlett | |
| 2005/0103525 | A1 | 5/2005 | Sangesland | |
| 2006/0196695 | A1 | 9/2006 | Giroux et al. | |
| 2007/0007014 | A1 | 1/2007 | Sessions et al. | |
| 2007/0175665 | A1 | 8/2007 | Tessari et al. | |
| 2007/0267221 | A1 | 11/2007 | Giroux et al. | |
| 2008/0169108 | A1 * | 7/2008 | Mondelli et al. | 166/386 |
| 2009/0101345 | A1 | 4/2009 | Moffitt et al. | |
| 2009/0107675 | A1 | 4/2009 | Eriksen et al. | |

OTHER PUBLICATIONS

Weatherford "R Running Tool with Hydraulically Released Mechanical Lock", 2006, pp. 1-2.

Drilling Contractor "Liner Drilling Technology Being Prepared for Offshore", Jan./Feb. 2004, pp. 14-15.

Dril-Quip LS-15 Liner Hanger System, Sales Manual, pp. 5-7.

TIW "Liner Equipment" HLX Liner-Top Packer, pp. 5, 9-11, 18-19.

Dril-Quip "LS-15 Liner Hanger System", pp. 1-2, 4 and 6.

U.S. Appl. No. 12/275,396, filed Nov. 21, 2008.

U.S. Appl. No. 12/238,191, filed Sep. 25, 2008.

World Oil/Oct. 1999—Drilling Technology "Casing-While-Drilling: The Next Step Change in Well Construction", pp. 34-36 and 38-40.

Drilling Liner Technology for Depleted Reservoir, C. Vogt, SPE and F. Makohl, SPE, Baker Hughes INTEQ; P. Suwarno, SPE and B. Quitzau, SPE, Mobil Oil Indonesia—SPE 36827—pp. 127-132.

Simultaneous Drill and Case Technology—Case Histories, Status and Options for Further Development, by Detlef Hahn, Baker Hughes Inteq, Wilhelmus Van Gestel, BP Amoco Norway AS, Norbert Frohlich, Baker Hughes Inteq, Glenn Stewart, Baker Hughes Inteq—SPE International, IADC/SPE 59126, Feb. 23-25, 2000, pp. 1-9.

U.S. Appl. No. 61/307,238, filed Feb. 23, 2010.

* cited by examiner

DAMPERED DROP PLUG

BACKGROUND OF THE INVENTION

1. Field of the Invention

The present invention relates in general to a method and apparatus for hydraulic actuation of a downhole tool and, in particular, to an apparatus and method for actuating one or more functions of a downhole tool with a dampered drop plug.

2. Brief Description of Related Art

A variety of tools exist to perform downhole functions in a well. Some tools may be actuated in response to mechanical movement or manipulation of the drill pipe, including rotation. Others may be actuated by dropping a ball or dart into the drill string, then applying fluid pressure to the interior of the string after the ball or dart lands on a seat in the tool. The tool may be attached to the liner hanger or body of a running tool by threads, shear elements, or by a hydraulically actuated arrangement.

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than an inner string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is assembled. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner, and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner, and retrieves the drill pipe.

For tools that are set by dropping a ball or dart into the drill string, such as the above described liner hanger, a seat in the running tool couples to the running tool by shear elements downhole from the hydraulically actuated tool. The shear elements are chosen to fail at a pressure greater than the pressure needed to operate the tool. The ball drops into the drill string to land on the seat in the running tool. Once landed, fluid pumps into the drill string, increasing the pressure within the drill string above the seated ball. Once the fluid pressure reaches a predetermined pressure, the tool actuates. Fluid pressure continues to increase until the shear pressure of the seat is reached. At this point, the shear elements of the seat fail, and the ball and seat fall, allowing the pressurized fluid to flow down the well.

In some instances, the drop ball will also be used to actuate a second hydraulically actuated tool. In these examples, a second seat in the running tool couples to the running tool axially below the first seat. Again, the second seat couples through the use of shear elements. Preferably, when the first shear elements fail, the ball drops to the second seat, again blocking the flow of fluid into downhole elements below the ball. Fluid continues to pump into the drill string, raising the pressure behind the ball until the second function actuates. Practically, when the first shear elements fail, the ball drops to the second seat, and the fluid pressure behind the ball acts as a water hammer on the second shear elements. The weight of the fluid column above the ball suddenly lands on the seat shear elements. The force exerted by the suddenly falling fluid often exceeds the shear strength of the second shear elements. This then causes the second shear elements to fail prior to activation of the second hydraulically activated tool. Therefore, there is a need for a drop ball system for actuating multiple hydraulically activated tools that overcomes the water hammer shear problems of current drop ball systems.

SUMMARY OF THE INVENTION

These and other problems are generally solved or circumvented, and technical advantages are generally achieved, by embodiments of the present invention that provide a dampered drop plug, and a method for using the same.

In accordance with an embodiment of the present invention, a dampered drop plug configured to be dropped down a bore of a drill string comprises a retainer configured to land on an upward facing shoulder of a tubular sleeve, and a plug releasably coupled to the retainer. The plug couples to the retainer while at a first pressure in the bore and decouples from the retainer at a second pressure in the bore. The retainer controls the flowrate of a fluid passing through the retainer after the plug decouples from the retainer.

In accordance with another embodiment of the present invention, a downhole tool for actuating a first and second function while dampening a water hammer effect comprises a tubular mandrel having an inner passage and an upper end that secures to a string of conduit to receive a flow of fluid, and an outer sleeve sealingly surrounding and axially movable relative to the mandrel. The outer sleeve defines an annulus between the outer sleeve and the mandrel. A piston is interposed between the mandrel and the outer sleeve, defining upper and lower chambers in the annulus. The tool further comprises an upper fluid port between the inner passage of the mandrel and the upper chamber, and a lower fluid port between the inner passage of the mandrel and the lower chamber. The chambers have piston areas configured such that pressurized fluid flow from the inner passage simultaneously into both of the ports causes a net axial force on the outer sleeve to move the outer sleeve and an engaging member in a first axial direction to actuate the first function. Pressurized fluid flowing through only the upper fluid port causes a net axial force on the outer sleeve to move the outer sleeve and the engaging member in a second axial direction to actuate the second function. The tool also comprises a dampered drop plug, and a seat in the inner passage between the upper and lower fluid ports. The dampered drop plug is configured to control the pressurized fluid flow through the inner passage following actuation of the second function. The seat is positioned such that positioning the dampered drop plug on the seat prevents communication of the pressurized fluid flow with the lower chamber, and allows communication of the pressurized fluid flow with the upper chamber.

In accordance with yet another embodiment, a method for actuating a plurality of functions with a dampered drop ball while dampening a water hammer effect comprises dropping a dampered drop plug into a drill string. The method further includes the step of actuating a first function with the dampered drop plug. The method then releases a plug of the dampered drop plug, and dampens a water hammer with a retainer of the dampered drop plug. The method then actuates a second function with the plug of the dampered drop plug.

An advantage of a preferred embodiment is that the dampered drop plug disclosed herein provides a means to actuate a plurality of hydraulically actuated functions in a downhole tool while dampening any water hammer effect associated with prior art drop ball methods and apparatuses. This dampening advantageously prevents premature shear of shear seat elements downhole from the actuation of the first function. In addition, the dampered drop plug disclosed herein can employ reusable parts and materials, extending the life of the dampered drop plug.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiments thereof which are illustrated in the appended drawings, which drawings form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, materials, and the like have been omitted inasmuch as such details are not considered necessary to obtain a complete understanding of the present invention, and are considered to be within the skills of persons skilled in the relevant art.

Figure 1:
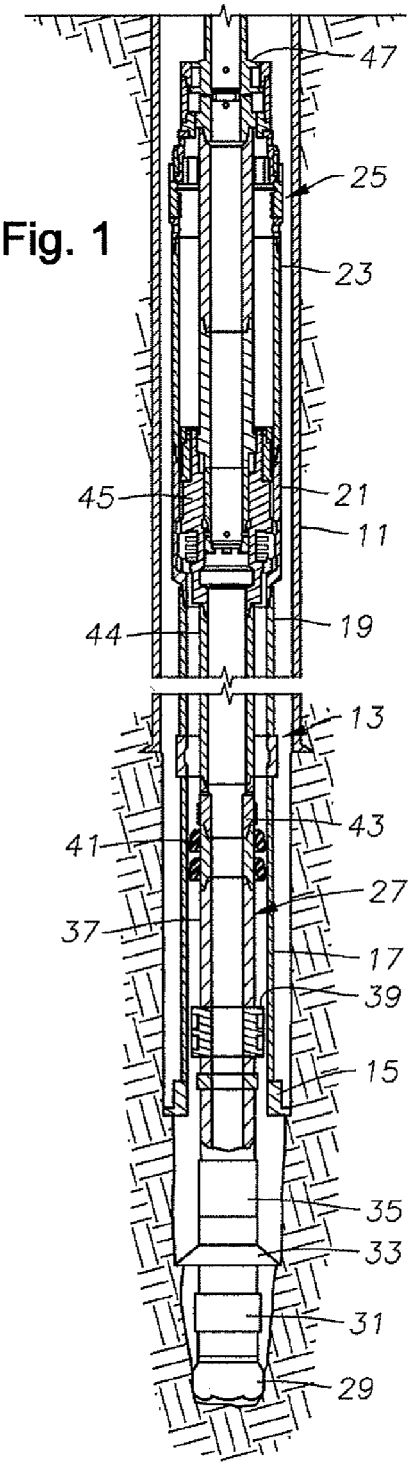
FIG. 1 is a schematic sectional view of inner and outer concentric strings during drilling.

Referring to FIG. 1, a well is shown having a casing 11 that is cemented in place. An outer string 13 is located within casing 11 and extends below to an open hole portion of the well. In this example, outer string 13 is made up of a drill shoe 15 on its lower end that may have cutting elements for reaming out the well bore. A tubular shoe joint 17 extends upward from drill shoe 15 and forms the lower end of a string of liner 19. Liner 19 comprises pipe that is typically the same type of pipe as casing, but normally is intended to be cemented with its upper end just above the lower end of casing 11, rather than extending all the way to the top of the well or landed in a wellhead and cemented. The terms "liner" and "casing" may be used interchangeably. Liner 19 may be several thousand feet in length.

Outer string 13 also includes a profile nipple or sub 21 mounted to the upper end of liner 19. Profile nipple 21 is a tubular member having grooves and recesses formed in it for use during drilling operations, as will be explained subsequently. A tieback receptacle 23, which is another tubular member, extends upward from profile nipple 21. Tieback receptacle 23 is a section of pipe having a smooth bore for receiving a tieback sealing element used to land seals from a liner top packer assembly or seals from a tieback seal assembly. Outer string 13 also includes in this example a liner hanger 25 that is resettable from a disengaged position to an engaged position with casing 11. For clarity, casing 11 is illustrated as being considerably larger in inner diameter than the outer diameter of outer string 13, but the annular clearance between liner hanger 25 and casing 11 may be smaller in practice.

An inner string 27 is concentrically located within outer string 13 during drilling. Inner string 27 includes a pilot bit 29 on its lower end. Auxiliary equipment 31 may optionally be incorporated with inner string 27 above pilot bit 29. Auxiliary equipment 31 may include directional control and steering equipment for inclined or horizontal drilling. It may include logging instruments as well to measure the earth formations.

In addition, inner string 27 normally includes an underreamer 33 that enlarges the well bore being initially drilled by pilot bit 29. Optionally, inner string 27 may include a mud motor 35 that rotates pilot bit 29 relative to inner string 27 in response to drilling fluid being pumped down inner string 27.

A string of drill pipe 37 is attached to mud motor 35 and forms a part of inner string 27. Drill pipe 37 may be conventional pipe used for drilling wells or it may be other tubular members. During drilling, a portion of drill pipe 37 will extend below drill shoe 15 so as to place drill bit 29, auxiliary equipment 31 and reamer 33 below drill shoe 15. An internal stabilizer 39 may be located between drill pipe 37 and the inner diameter of shoe joint 17 to stabilize and maintain inner string 27 concentric.

Optionally, a pack off 41 may be mounted in the string of drill pipe 37. Pack off 41 comprises a sealing element, such as a cup seal, that sealingly engages the inner diameter of shoe joint 17, which forms the lower end of liner 19. If utilized, pack off 41 forms the lower end of an annular chamber 44 between drill pipe 37 and liner 19. Optionally, a drill lock tool 45 at the upper end of liner 19 forms a seal with part of outer string 13 to seal an upper end of inner annulus 44. In this example, a check valve 43 is located between pack off 41 and drill lock tool 45. Check valve 43 admits drilling fluid being pumped down drill pipe 37 to inner annulus 44 to pressurize inner annulus 44 to the same pressure as the drilling fluid flowing through drill pipe 37. This pressure pushes downward on pack off 41, thereby tensioning drill pipe 37 during drilling. Applying tension to drill pipe 37 throughout much of the length of liner 19 during drilling allows one to utilize lighter weight pipe in the lower portion of the string of drill pipe 37 without fear of buckling. Preferably, check valve 43 prevents the fluid pressure in annular chamber 44 from escaping back into the inner passage in drill pipe 37 when pumping ceases, such as when an adding another joint of drill pipe 37.

Drill pipe 37 connects to drill lock tool 45 and extends upward to a rotary drive and weight supporting mechanism on the drilling rig. Often the rotary drive and weight supporting mechanism will be the top drive of a drilling rig. The distance from drill lock tool 45 to the top drive could be thousands of feet during drilling. Drill lock tool 45 engages profile nipple 21 both axially and rotationally. Drill lock tool 45 thus transfers the weight of outer string 13 to the string of drill pipe 37. Also, drill lock tool 45 transfers torque imposed on the upper end of drill pipe 37 to outer string 13, causing it to rotate in unison.

A liner hanger control tool 47 is mounted above drill lock tool 45 and separated by portions of drill pipe 37. Liner hanger control tool 47 is a hydraulic mechanism employed to release and set liner hanger 25 and also to release drill lock tool 45. Drill lock tool 45 is located within profile nipple 21 while liner hanger control tool 47 is located above liner hanger 25 in this example.

In brief explanation of the operation of the equipment shown in FIG. 1, normally during drilling the operator rotates drill pipe 37 at least part of the time, although on some occasions only mud motor 35 is operated, if a mud motor is utilized. Rotating drill pipe 37 from the drilling rig, such as the top drive, causes inner string 27 to rotate, including drill bit 29. Some of the torque applied to drill pipe 37 is transferred from drill lock tool 45 to profile nipple 21. This transfer of torque causes outer string 13 to rotate in unison with inner string 27. In this embodiment, the transfer of torque from inner string 27 to outer string 13 occurs only by means of the engagement of drill lock tool 45 with profile nipple 21. The operator pumps drilling fluid down inner string 27 and out nozzles in pilot bit 29. The drilling fluid flows back up an annulus surrounding outer string 13.

If, prior to reaching the desired total depth for liner 19, the operator wishes to retrieve inner string 27, he may do so. In this example, the operator actuates liner hanger control tool 47 with a dampered drop plug 70, as described in more detail with respect to FIGS. 7-10, to move the slips of liner hanger 25 from a retracted position to an engaged position in engagement with casing 11. The operator then slacks off the weight on inner string 27, which causes liner hanger 25 to support the weight of outer string 13. Using liner hanger control tool 47, the operator also releases the axial lock of drill lock tool 45 with profile nipple 21. This allows the operator to pull inner string 27 while leaving outer string 13 in the well. The operator may then repair or replace components of the bottom hole assembly including drill bit 29, auxiliary equipment 31, underreamer 33 and mud motor 35. The operator also resets liner hanger control tool 47 and drill lock tool 45 for a reentry engagement, then reruns inner string 27. The operator actuates drill lock tool 45 to reengage profile nipple 21 and lifts inner string 27, which causes drill lock tool 45 to support the weight of outer string 13 and release liner hanger 25. The operator reengages liner hanger control tool 47 with liner hanger 25 to assure that its slips remain retracted. The operator then continues drilling. When at total depth, the operator repeats the process to remove inner string 27, then may proceed to cement outer string 13 into the well bore. More details of the various components and their operation are shown in US published patent application 2009/0107675, published Apr. 30, 2009.

Figure 2:
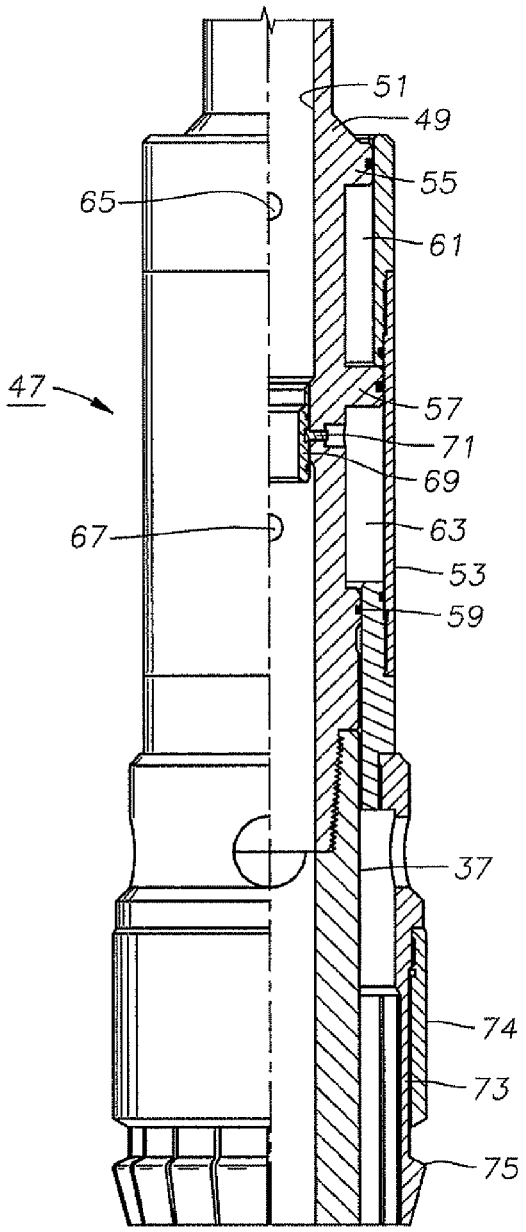
FIG. 2 is an enlarged partial sectional view of a liner hanger control tool of the system of FIG. 1, employing the dampered drop plug of FIG. 10, and shown in a position employed during drilling.

FIG. 2 illustrates one example of liner hanger control tool 47, which may also be referred to as a running tool. In this embodiment, liner hanger control tool 47 has a tubular mandrel 49 with an axial flow passage 51 extending through it. The lower end of mandrel 49 connects to a length of drill pipe 37 that extends down to drill lock tool 45. The upper end of mandrel 49 connects to additional strings of drill pipe 37 that lead to the drilling rig. An outer housing 53 surrounds mandrel 49 and is axially movable relative to mandrel 49. In this embodiment, an annular upper piston 55 extends around the exterior of mandrel 49 outward into sealing and sliding engagement with outer housing 53. An annular central piston 57, located below upper piston 55, extends outward from mandrel 49 into sliding engagement with another portion of outer housing 53. Outer housing 53 is formed of multiple components in this example, and the portion engaged by central piston 57 has a greater inner diameter than the portion engaged by upper piston 55. An annular lower piston 59 is formed on the exterior of mandrel 49 below central piston 57. Lower piston 59 sealingly engages a lower inner diameter portion of outer housing 53. The portion engaged by lower piston 59 has an inner diameter that is less than the inner diameter of the portion of outer housing 53 engaged by upper piston 55.

Pistons 55, 57, 59 and outer housing 53 define an upper annular chamber 61 and a lower annular chamber 63. An upper port 65 extends between mandrel axial flow passage 51 and upper annular chamber 61. A lower port 67 extends from mandrel axial flow passage 51 to lower annular chamber 63. Sleeve 69 is located in axial flow passage 51 between upper and lower ports 65, 67. Sleeve 69 faces upward and preferably is an annular sleeve, as described below with respect to FIG. 10, retained by a pin or bolt 71. Preferably, bolt 71 is not a shear element.

A collet 73 is attached to the lower end of outer sleeve 53. Collet 73 has downward depending fingers 75. An external sleeve 74 surrounds an upper portion of fingers 75. Fingers 75 have upward and outward facing shoulders and are resilient so as to deflect radially inward. Fingers 75 are adapted to engage liner hanger 25, shown in FIG. 3. Liner hanger 25 includes a sleeve 76 containing a plurality of gripping members or slips 77 carried within windows 79. When pulled upward, slips 77 are cammed out by ramp surfaces so that they protrude from the exterior of sleeve 76 and engage casing 11 (FIG. 1). Slips 77 are shown in the retracted position in FIG. 3. While slips 77 are extended, applying weight to sleeve 76 causes slips 77 to grip casing 11 more tightly. Fingers 75 (FIG. 2) of collet 73 snap into a recess in slips 77 (FIG. 3) to lift them when outer sleeve 53 moves up relative to liner hanger 25. When outer sleeve 53 moves downward relative to liner hanger 25, the sleeve 74 contacts slips 77 to prevent them from moving up.

Figure 3:
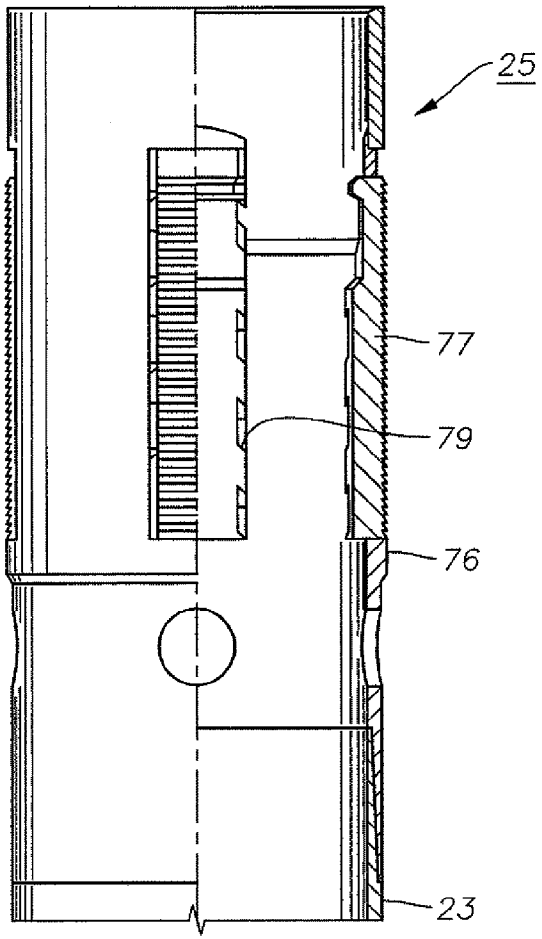
FIG. 3 is an enlarged partial sectional view of the liner hanger employed in the system of FIG. 1 and shown in the retracted position.
Figure 4:
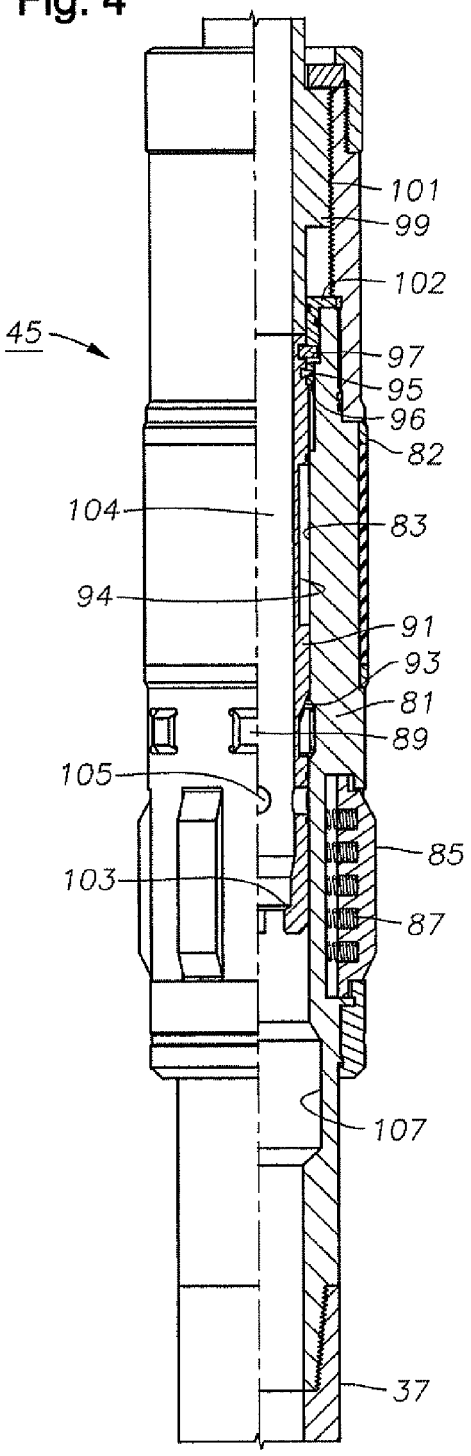
FIG. 4 is an enlarged partial sectional view of a drill lock tool employed with the system of FIG. 1, with its cone mandrel shown in a run-in position.

In explanation of the components shown in FIGS. 3 and 4, liner hanger control tool 47 is shown in a released position. Applying drilling fluid pressure to passage 51 causes pressurized drilling fluid to enter both ports 65 and 66 and flow into chambers 61 and 63. The same pressure acts on pistons 55, 57 and 57, 59, resulting in a net downward force that causes outer sleeve 53 and fingers 75 to move downward to the lower position shown in FIG. 2. In the lower position, the shoulder at the lower end of chamber 61 approaches piston 57 while sleeve 74 transfers the downward force to slips 77 (FIG. 3), maintaining slips 77 in their lower retracted position.

As will be explained in more detail subsequently, to retrieve inner string 27 (FIG. 1), the operator drops dampered drop plug 70 (FIG. 7) onto first sleeve 69. The drilling fluid pressure is now applied only through upper port 65 to upper chamber 61 and not lower port 67. The differential pressure areas of pistons 55 and 57 causes outer sleeve 53 to move upward relative to mandrel 49, bringing with it fingers 75 and slips 77 (FIG. 3). Then, slacking weight off inner string 27 will cause slips 77 to grip casing 11 (FIG. 1). Liner hanger control tool 47 thus has porting within it that in one mode causes outer sleeve 53 to move downward to retract liner hanger slips 77 and in another mode to move upward to set slips 77. Arrangements other than the three differential area pistons 55, 57 and 59 may be employed to move outer sleeve 53 upward and downward.

An example of drill lock tool 45 is illustrated in FIG. 4. Drill lock tool 45 has a multi-piece housing 81 containing a bore 83. Annular seals 82 on the exterior of housing 81 are adapted to sealingly engage profile nipple 21 (FIG. 6) to form the sealed upper end of annular chamber 44 (FIG. 4). Torque keys 85 are mounted to and spaced around the exterior of housing 81. Torque keys 85 are biased outward by springs 87 for engaging axial slots (not shown) located within profile nipple 21 (FIG. 1). When engaged, rotation of housing 81 transmits torque to profile nipple 21 (FIG. 1). Drill lock tool 45 also has an axial lock member, which in this embodiment comprises a plurality of dogs or axial locks 89, each located within a window formed in housing 81. Each axial lock 89 has an inner side exposed to bore 83 and an outer side capable of protruding from housing 81. When in the extended position, axial locks 89 engage an annular groove 90 (FIG. 6) in profile nipple 21. This engagement axially locks drill lock tool 45 to profile nipple 21 and enables inner string 27 (FIG. 1) to support the weight of outer string 13.

Figure 6:
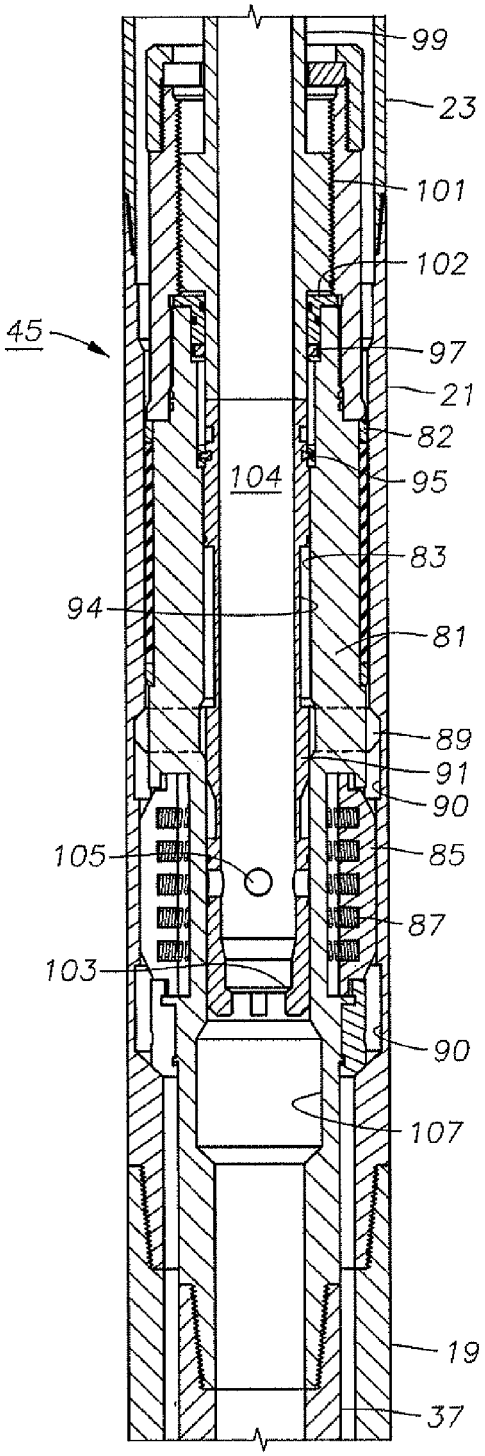
FIG. 6 is a sectional view of the drill lock tool of FIG. 4 with its cone mandrel shown in a set position.
Figure 9:
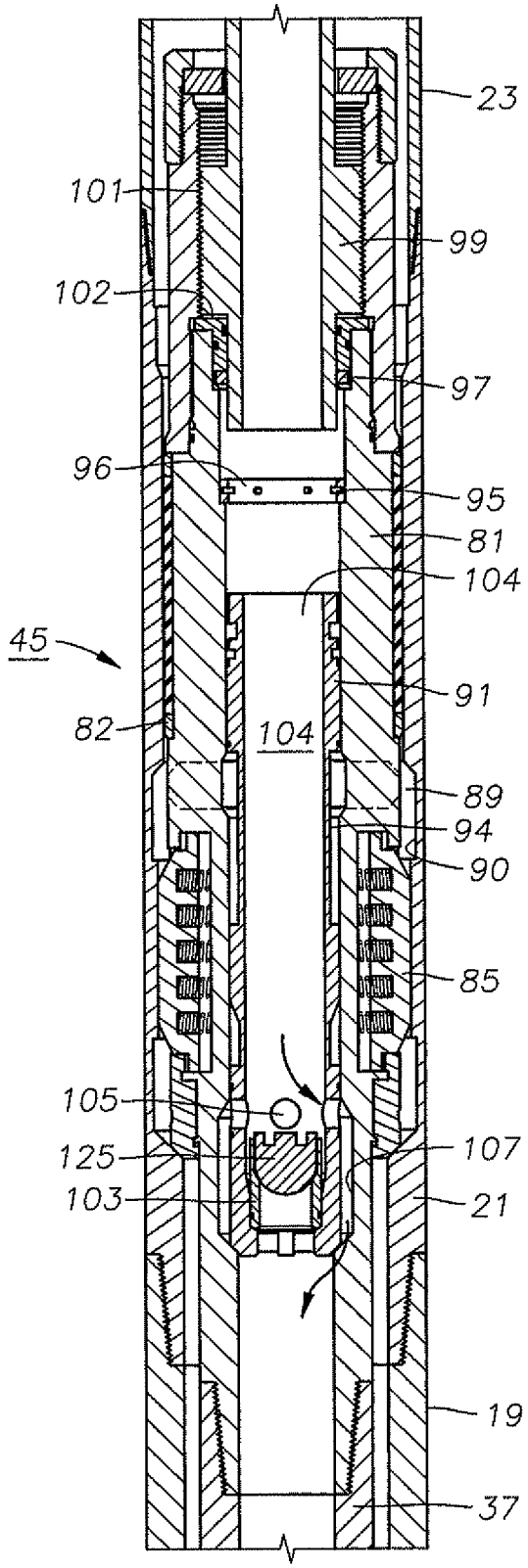
FIG. 9 is a sectional view of the drill lock tool of FIG. 4, with its cone mandrel in the released position.

Referring to FIG. 4, axial locks 89 are moved from the retracted to the extended position and retained in the extended position by a cone mandrel 91 that is carried within housing 81. Cone mandrel 91 has a ramp 93 that faces downwardly and outwardly. When cone mandrel 91 is moved downward in housing 81, ramp 93 pushes axial locks 89 from their retracted to the extended position. Cone mandrel 91 has three positions in this example. A run-in position is shown in FIG. 1, wherein ramp 93 is spaced above axial locks 89. Downward movement of cone mandrel 91 from the run-in position moves it to the set position, which is shown in FIG. 6. In the set position, axial locks 89 are maintained in the extended position by the back-up engagement of a cylindrical portion of cone mandrel 91 just above ramp 93. Downward movement from the set position in housing 81 places cone mandrel 91 in the released position, which is illustrated in FIG. 9. In the released position, annular recess 94 (FIG. 4) on the exterior of cone mandrel 91 aligns with the inner ends of axial locks 89. This allows axial locks 89 to move inward to the retracted position when drill lock tool 45 is lifted.

Figure 7:
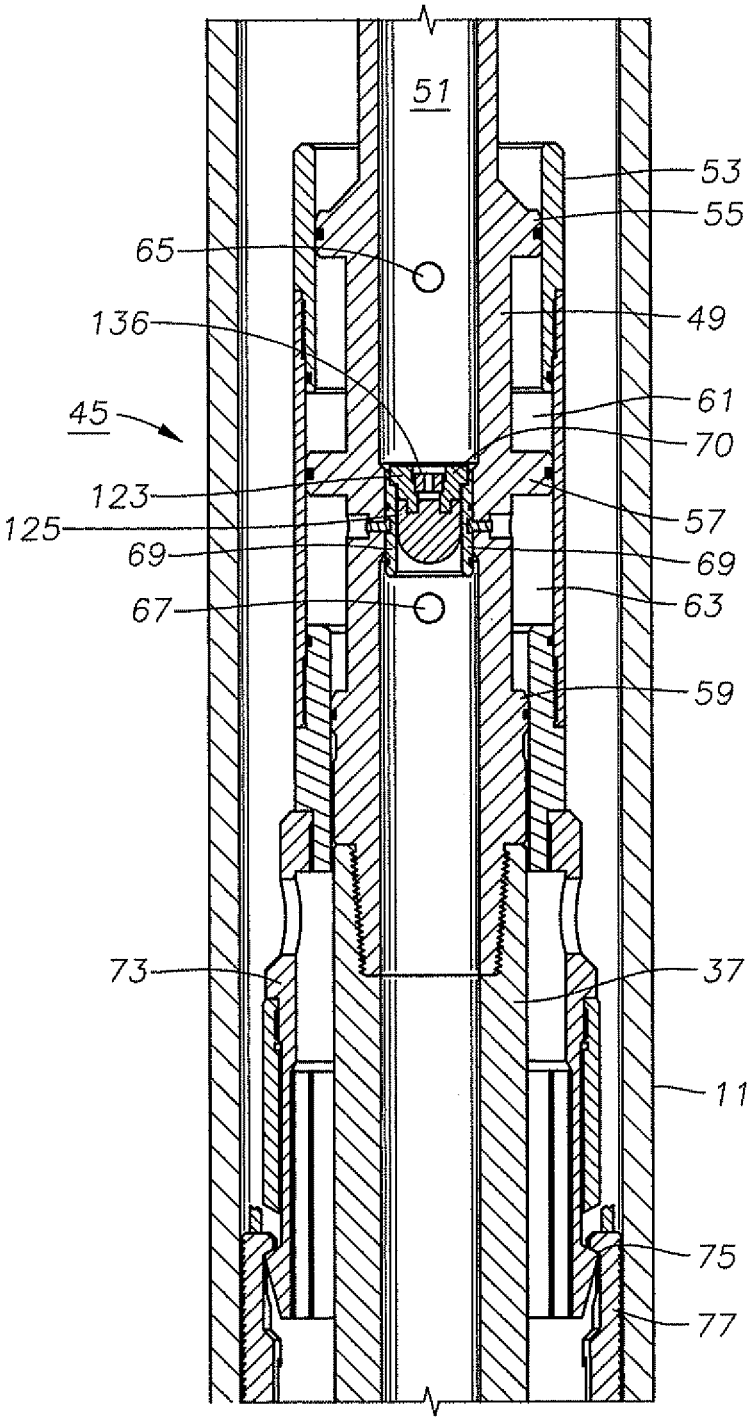
FIG. 7 is a sectional view of the liner hanger control tool of FIG. 2, with the liner hanger control tool in the process of moving from the set position to a released position.

Referring again to FIG. 4, shear screws 95 are connected between cone mandrel 91 and a ring 96. Ring 96 is free to slide downward with cone mandrel 91 as it moves from the run-in position (FIG. 4) to the set position (FIG. 7). In the set position, ring 96 lands on an upward-facing shoulder formed in bore 83 of housing 81, retaining cone mandrel 91 in the set position. Shear screws 95 shear when cone mandrel 91 is moved from the set position to the released position (FIG. 9).

Reentry shear screws 97 are shown connected between cone mandrel 91 and a shoulder member 102, which is a part of housing 81. Preferably reentry shear screws 97 are not installed during the initial run-in of the liner drilling system of FIG. 1. Rather, they are installed only for use during re-entry of drill lock tool 45 back into engagement with profile nipple 21.

In this example, cone mandrel 91 is moved from its run-in position to its set position by a downward force applied from a threaded stem 99 extending axially upward from cone mandrel 91. Stem 99 has external threads 101 that engage mating threads formed within bore 83. Rotating threaded stem 99 will cause it to move downward from the upper position shown in FIG. 3 to the lower position in FIG. 5, exerting a downward force on cone mandrel 91. Cone mandrel 91 is a separate component from threaded stem 99 in this embodiment, and does not rotate with it. Threads 101 may be of a multi-start high pitch type. Threaded stem 99 is connected to drill pipe 37 (FIG. 1) that extends upward to liner hanger control tool 47. While threaded stem 99 is in the lower position, it will be in contact with shoulder member 102 located in bore 83 of housing 81.

A seat 103 is formed within an axial flow passage 104 in cone mandrel 91. Seat 103 faces upward and in this embodiment it is shown on the lower end of axial passage 104. A port 105 extends from passage 104 to the exterior of cone mandrel 91. An annular cavity 107 is located in bore 83 below the lower end of cone mandrel 91 while cone mandrel 91 is in its run-in (FIG. 4) and set (FIG. 6) positions. When cone mandrel 91 is in the lowest or released position, which is the position shown in FIG. 9, ports 105 will be aligned with cavity 107. This alignment enables fluid being pumped down passage 104 to flow around plug 125 of dampered drop plug 70 when it is located on seat 103 as shown in FIG. 9.

Figure 5:
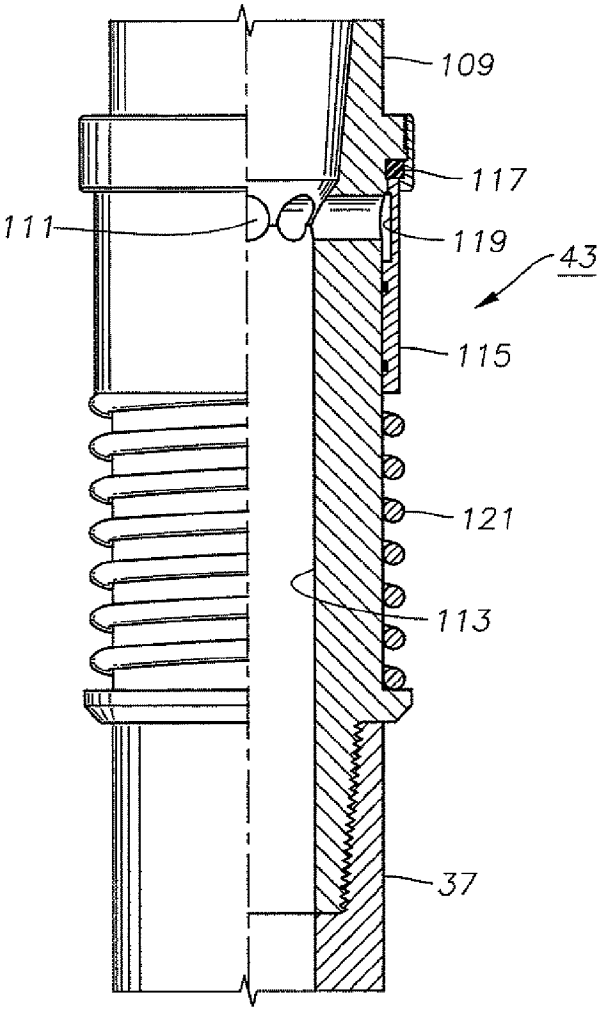
FIG. 5 is a sectional view of a check valve employed with the inner string of the system of FIG. 1 and shown in a closed position.

Referring to FIG. 5, an example of check valve 43 is illustrated. Check valve 43 has a body 109 that is tubular and has upper and lower threaded ends for a connection into drill pipe 37. One or more ports 111 extend from axial passage 113 to the exterior of body 109. A sleeve 115 is carried moveably on the exterior of body 109. Sleeve 115 has interior seals that seal to the exterior of body 109. Sleeve 115 also has an upper end that engages a seal 117. Sleeve 115 has an annular cavity 119 that aligns with ports 111 when sleeve 115 is in the closed or upper position. The pressure area formed by annular cavity 119 results in a downward force on sleeve 115 when drilling fluid pressure is supplied to passage 113. Normal drilling fluid pressure creates a downward force that pushes sleeve 115 downward, compressing a coil spring 121 and allowing flow out ports 117. When the drilling fluid pumping ceases, the pressure within passage 113 will be the same as on the exterior of body 109. Spring 121 will then close ports 111. As shown in FIG. 1, the closure of ports 111 will seal the higher drilling fluid pumping pressure within inner annulus 44, maintaining the portion of drill string 37 between seals 82 (FIG. 6) of drill lock tool 45 and pack off 41 in tension.

In the operation of the embodiment shown in FIGS. 1-6, the operator would normally first assemble and run liner string 19 and suspend it at the rig floor of the drilling rig. The operator would make up the bottom hole assembly comprising drill bit 29, auxiliary equipment 31 (optional), reamer 33 and mud motor 35 (optional), check valve 43, and pack off 41 and run it on drill pipe 37 into outer string 13. When a lower portion of the bottom hole assembly has protruded out the lower end of outer string 13 sufficiently, the operator supports the upper end of drill pipe 37 at a false rotary on the rig floor. Thus, the upper end of liner string 19 will be located at the rig floor as well as the upper end of drill pipe 37. Preferably, the operator preassembles an upper assembly to attach to liner string 19 and drill pipe 37. The preassembled components include profile nipple 21, tieback receptacle 23 and liner hanger 25. Drill lock tool 45 and liner hanger control tool 47 as well as intermediate section of drill pipe 37 would be located inside. Drill lock tool 45 would be axially and rotationally locked to profile nipple 21. The operator picks up this upper assembly and lowers it down over the upper end of liner 19 and the upper end of drill pipe 37. The operator connects the upper end of drill pipe 37 to the lower end of housing 81 (FIG. 3) of drill lock tool 45. The operator connects the lower end of profile nipple 21 to the upper end of liner 19.

The operator then lowers the entire assembly in the well by adding additional joints of drill pipe 37. The weight of outer string 13 is supported by the axial engagement between profile nipple 21 and drill lock tool 45. When on or near bottom, the operator pumps drilling fluid through drill pipe 37 and out drill bit 29, which causes drill bit 29 to rotate if mud motor 35 (FIG. 1) is employed. The operator may also rotate drill pipe 37. As shown in FIG. 2, the drilling fluid pump pressure will exist in both upper and lower chamber 61, 63, which results in a net downward force on sleeve 74. Sleeve 74 will be in engagement with the upper ends of slips 77 (FIG. 3) of liner hanger 25, maintaining slips 77 in the retracted position.

Figure 10:
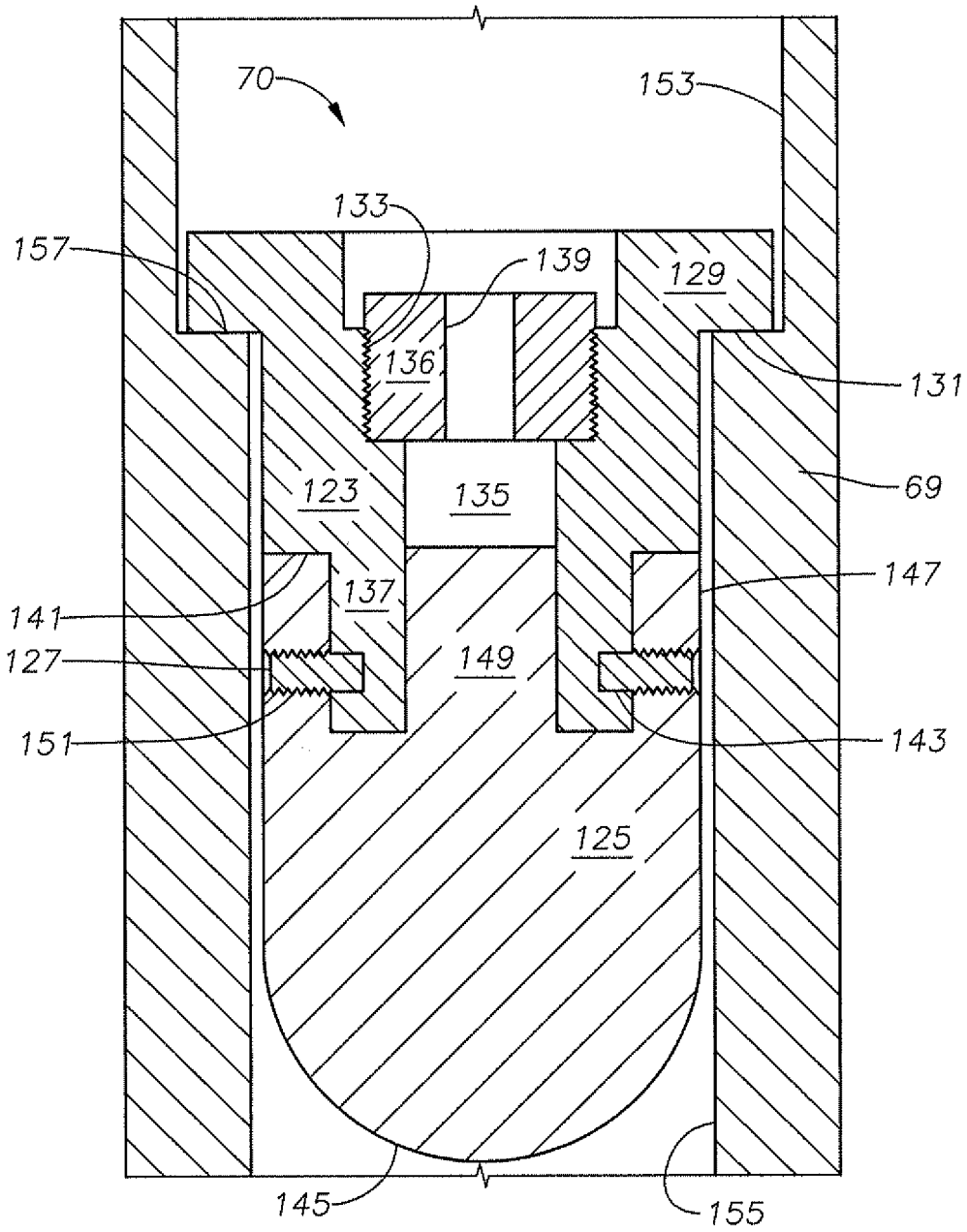
FIG. 10 is a schematic sectional view of a dampered drop plug in accordance with an embodiment of the present invention.

Referring to FIG. 10, dampered drop plug 70 comprises a retainer 123 and a plug 125 coupled together by shear screws 127. Shear screws 127 comprise shear elements selected to shear at a predetermined fluid pressure. In the illustrated embodiment, two shear screws 127 are used. A person skilled in the art will understand that more or fewer shear elements of any suitable material may be used as desired, provided that together the elements will fail at the predetermined fluid pressure.

Retainer 123 comprises an annular upset 129 extending from a top portion of retainer 123 radially outward. Upset 129 defines a downward facing shoulder 131. Retainer 123 further defines a threaded bore 133 near a center of retainer 123, and a non-threaded bore 135 coaxial with and below threaded bore 133. Non-threaded bore 135 has a diameter that is less than a diameter of threaded bore 133. A bit jet 136 threads into threaded bore 133 and directs the passage of fluid through a jet opening 139 from the area of a mandrel axial flow passage 51 (FIG. 2) above dampered drop plug 70 to an area of mandrel axial flow passage 51 below retainer 123 following shear of shear screws 127. Bit jet 136 may be formed of any suitable material such as plastics, brass, and the like.

Retainer 123 further comprises an axial annular extension 137 extending from a lower portion of retainer 123 toward plug 125. An inner diameter surface of annular extension 137 defines an interior wall of non-threaded bore 135. Annular extension 137 also defines threaded shear screw holes 143 in an outer diameter surface of annular extension 137. Threaded shear screw holes 143 are configured to receive a portion of shear screws 127. Retainer 123 also defines a lower downward facing shoulder 141 extending from the outer diameter surface of retainer 123 to a base of annular extension 137.

Plug 125 comprises a convex shaped lower portion 145, an upper extension 147, and a center plug 149. Convex shaped lower portion 145 is configured to land on a ball seat, such as seat 103 of FIG. 4, described in more detail below. Upper extension 147 comprises an annular ring extending from an upper portion of plug 125 parallel to annular extension 137 of retainer 123. An exterior diameter of upper extension 147 defines the exterior surface of plug 125. An interior surface of upper extension 147 abuts an exterior surface of annular extension 137. Upper extension 147 terminates at lower downward facing shoulder 141. Upper extension 147 defines exterior threaded shear screw holes 151. Exterior threaded shear screw holes 151 pass through upper extension 147 and are proximate to threaded shear screw holes 143. Exterior threaded shear screw holes 151 are configured to receive a portion of shear screws 127.

Center plug 149 comprises an extension of plug 125 protruding from the upper portion of plug 125 and substantially filling non-threaded bore 135. Center plug 149 defines a surface configured to receive a fluid and transmit the force of the fluid through plug 125 to shear screws 127. In the illustrated embodiment, center plug 149 has a height approximately equal to the height of upper extension 147, thereby defining a channel into which annular extension 137 of retainer 123 is inserted.

Sleeve 69 comprises an annular sleeve coupled to mandrel 49 (FIG. 2) along a wall of mandrel axial flow passage 51 (FIG. 2). Sleeve 69 defines upper narrowed axial flow passage 153 and lower narrowed axial flow passage 155. A diameter of lower narrowed axial flow passage 155 is approximately equal to the exterior diameter of dampered drop plug 70. Similarly, a diameter of upper narrowed axial flow passage 153 is approximately equal to the exterior diameter of upset 129. Sleeve 69 forms an upward facing shoulder 157 at the transition between upper narrowed axial flow passage 153 and lower narrowed axial flow passage 155. As illustrated, downward facing shoulder 131 lands and rests on upward facing shoulder 157, holding dampered drop plug 125 axially in place in mandrel axial flow passage 51 (FIG. 2).

In operation, an operator drops dampered drop plug 70 into a drill string at the surface of a drilling rig and then pumps dampered drop plug 70 down to land at sleeve 69 coming to rest as depicted in FIG. 10. As illustrated in FIG. 7, dampered drop plug 70 blocks the flow of fluid further down the drill string 37. Continued pumping of fluid into the drill string builds the fluid pressure until a hydraulically actuated tool, such as liner hanger control tool 47 (FIG. 7), actuates. Operators continue to pump fluid into the drill string until a predetermined pressure is reached that is high enough to shear screws 127, releasing the plug 125 to travel further down the drill string.

When shear screws 127 shear and plug 125 releases from retainer 129, bit jet 136 then controls flow of fluid past retainer 129. Rather than allow the weight of the entire column of fluid above retainer 129 to suddenly slam down onto the column of fluid below retainer 129, causing premature shear to subsequent shear elements, such as seat 103 (FIG. 4), bit jet 136 allows fluid to pass in a controlled manner. This prevents the entire weight of the fluid column above bit jet 136 from slamming into the fluid column below bit jet 136. By controlling the rate at which fluid flows past retainer 129, the dampered drop plug 70 prevents premature shear of subsequent shear elements. This allows a hydraulically actuated tool to operate as originally designed by first landing plug 125 on a seat below sleeve 69, and then repeating the fluid pressure buildup process to perform another function.

The flow rate through bit jet 136 is selected based on the particular application of dampered drop plug 70 and the downhole tools to be operated. Most downhole tools have much smaller operating volume than the volume of fluid pumped by a mud pump connected to a drill string. Therefore, bit jet 136 and the diameter of bit jet opening 139 will be selected to provide the flowrate needed for operation of the selected downhole tool.

As a further example, while drilling, if it is desired to repair or replace portions of the bottom hole assembly, the operator drops dampered drop plug 70 down drill pipe 37. As illustrated in FIG. 7, dampered drop plug 70 lands on sleeve 69 in liner hanger control tool 47. The drilling fluid pressure now communicates only with upper chamber 61 because dampered drop plug 70 is blocking the entrance to lower port 67. This results in upward movement of outer sleeve 53 and fingers 75 relative to mandrel 49, causing liner hanger slips 77 to move to the set or extended position in contact with casing 11 (FIG. 1). The operator slacks off weight on drill pipe 37, which causes slips 77 to grip casing 11 and support the weight of outer string 13.

Figure 8:
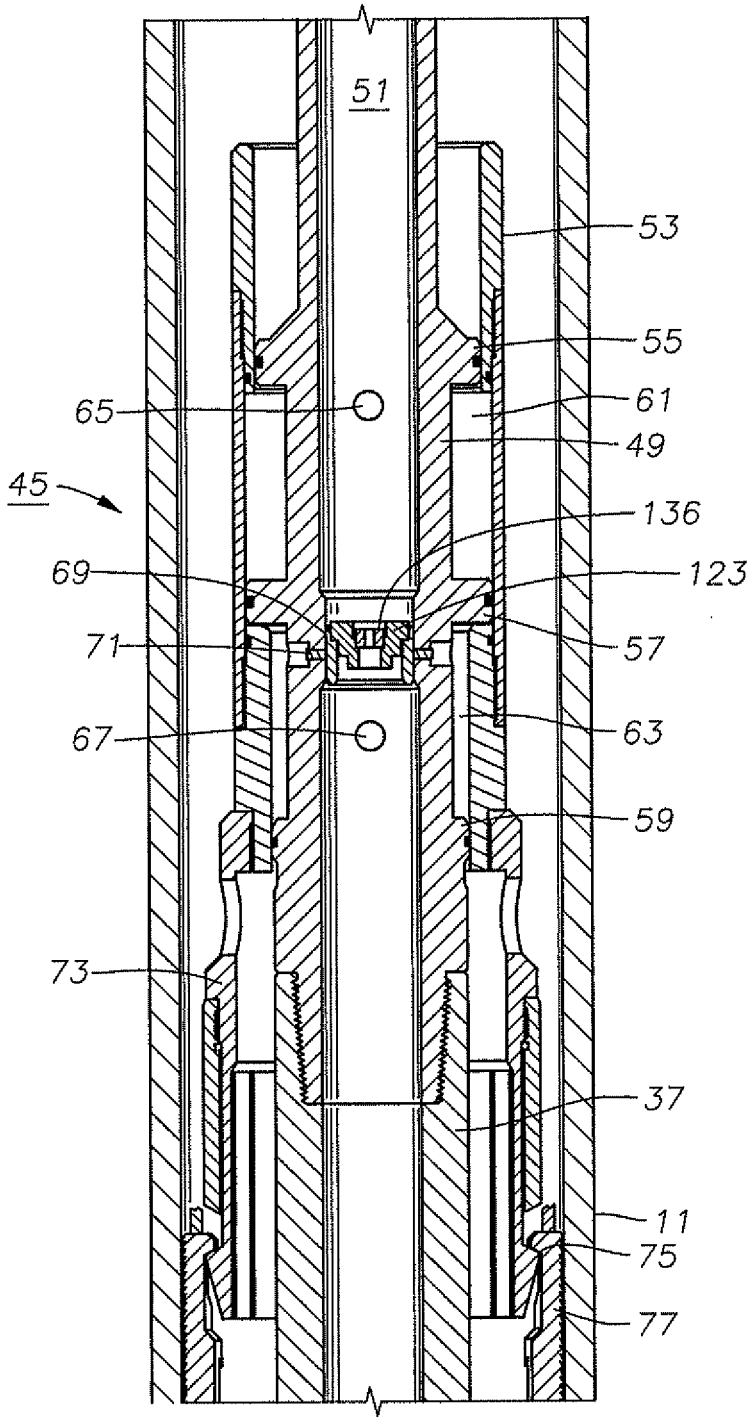
FIG. 8 is a sectional view of the liner hanger control tool of FIG. 2, shown in the released position and with its ball seat sheared.

The operator then increases the pressure of the drilling fluid in drill pipe 37 above dampered drop plug 70 to a second pressure level. This increased pressure shears shear screws 127 (FIG. 10), causing plug 125 to move downward out of liner hanger control tool 47 as shown in FIG. 8, leaving retainer 123 in place on sleeve 69. Plug 125 drops down into engagement with seat 103 in cone mandrel 91 as shown in FIG. 9. Bit jet 136 (FIG. 10) controls the flow of fluid through liner hanger control tool 47 preventing the weight of the drilling fluid column above bit jet 136 from causing a water hammer effect further down drill pipe 37. In this manner, dampered drop plug 70 prevents premature shear of seat 103 in cone mandrel 91. Once plug 125 lands on seat 103, the drilling fluid pressure then acts on plug 125, shears shear screws 95, and pushes cone mandrel 91 from the set position to the released position shown in FIG. 9. When in the released position, the drilling fluid flow will be bypassed around plug 125 and flow downward and out pilot bit 29 (FIG. 1). The operator then pulls inner string 27 from the well, leaving outer string 13 suspended by liner hanger 25. If no reentry is desired, the operator would then proceed to cementing.

In an alternative embodiment of the present invention, a valve 48 (FIGS. 11 and 12) is positioned upstream of liner hanger control tool 47. Valve 48 is employed to meter flow from within inner string 27 to the outer annular space to thereby maintain sufficient flow rate in the annular space to prevent cuttings from the drilling operation to settle on liner hanger control tool 47.

Figure 11:
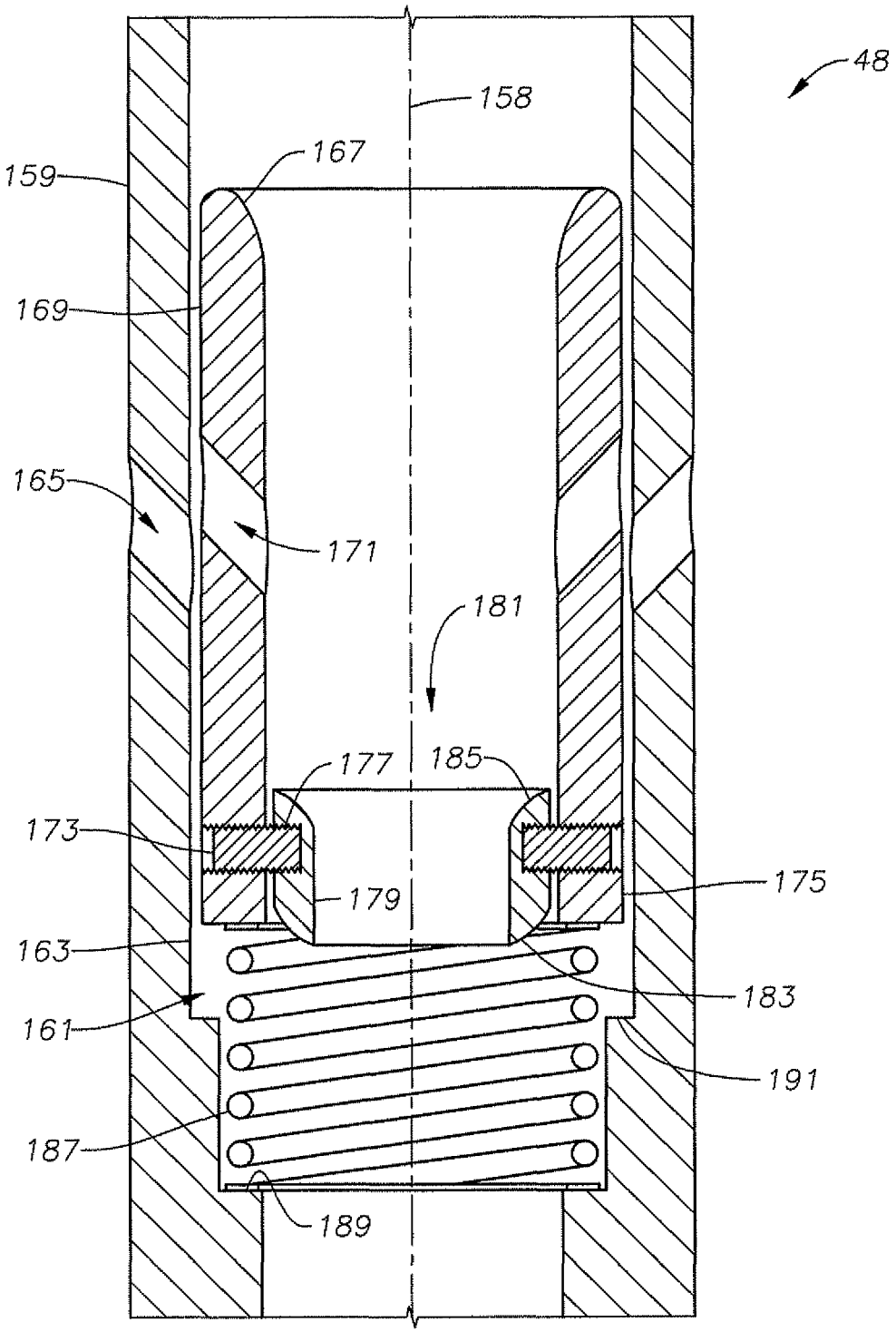
FIG. 11 is a partial sectional view of a diverter valve shown in a closed position and optionally coupled to the inner string of FIG. 1.
Figure 12:
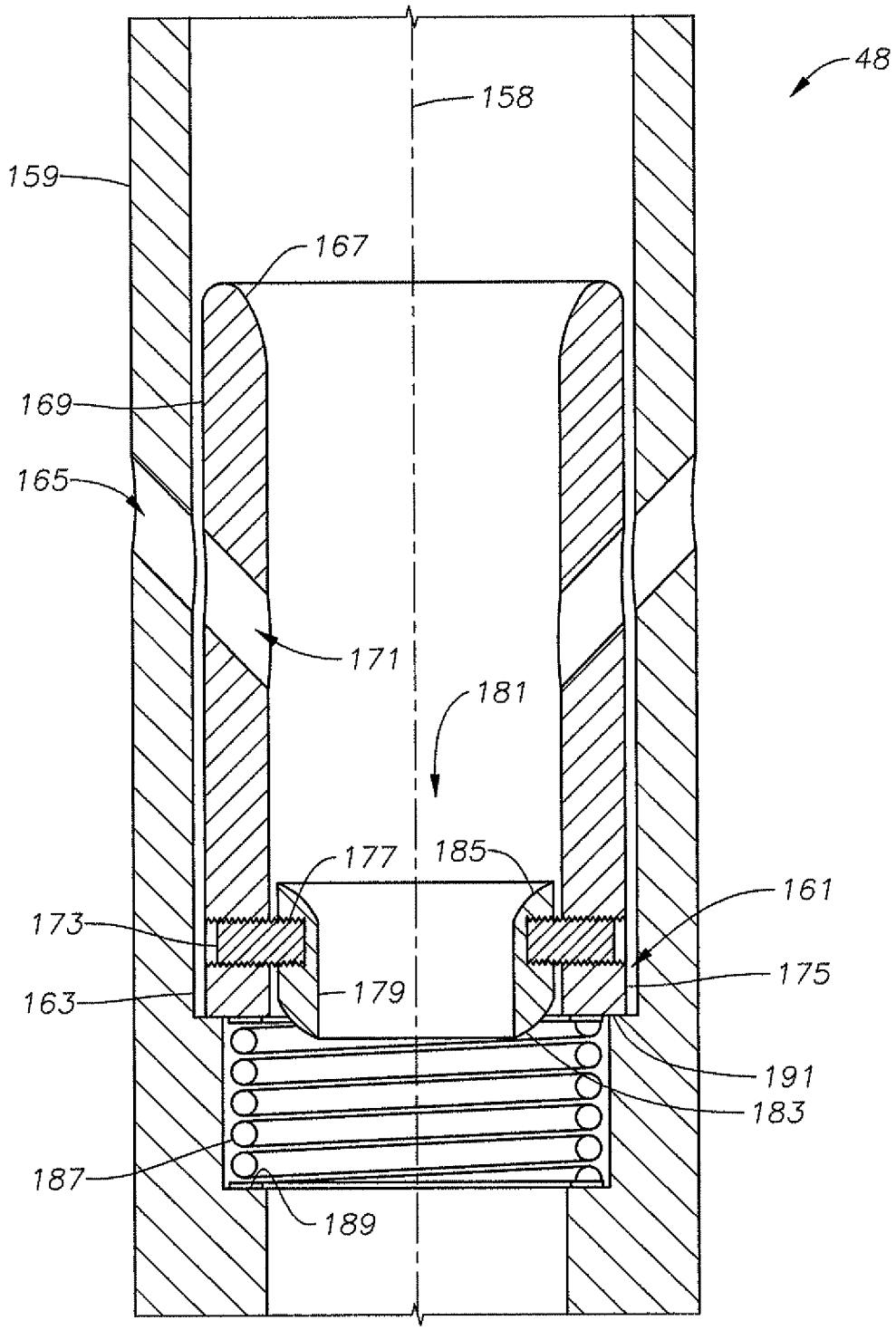
FIG. 12 is a partial sectional view of the diverter valve of FIG. 11 shown in an open position.

FIGS. 11 and 12 illustrate a partial sectional view of valve 48 connected to an upstream end of liner hanger control tool 47 is shown. The valve may have threaded ends to connect to the tool or a short distance above liner hanger control tool 47, and may be either retrievable or non-retrievable. Valve 48 is symmetrical about axis 158. FIG. 11 shows valve 48 in a closed position while FIG. 12 shows valve 48 in an open position. Valve 48 also has intermediate positions to allow metering of flow. The valve comprises a housing 159 having threaded connections at each end with a machined internal profile 163 to accept internal components. The valve maintains a minimum flow rate to the downstream side while exhausting excess flow to the outer annular area. In this embodiment, housing 159 has ports 165 that communicate an inner diameter with an outer diameter of housing 159. Ports 165 are inclined radially outward in an upstream direction.

Still referring to FIG. 11, a sleeve 167 is shown within internal profile 163 of housing 159 such that an outer surface 169 of sleeve 167 is in close reception with internal profile 163. Sleeve 167 can axially slide relative to the housing 159. In this embodiment, sleeve 167 has ports 171 that communicate an inner diameter of sleeve 167 with an outer diameter of sleeve 167. As with ports 165 on housing 159, ports 171 on sleeve 167 are inclined radially outward in an upstream direction. When valve 48 is in the closed position shown in FIG. 11, ports 171 of sleeve 167 do not align with ports 165 of housing 159. This closed position may be associated to a low flow rate, such as 100 GPM or less, depending on the application. When partially or fully open, as shown in FIG. 12, sleeve 167 will slide down relative to housing 159 such that ports 171 will at least partially align with ports 165 to thereby allow a portion of the fluid flowing in the inner string 27 (FIG. 1) to flow through ports 171, 165 and into the outer annular space. As an example, the valve may be designed to be partially open when the flow rate is approximately 150 GPM and fully open at higher flow rates, such as 200 GPM. In one embodiment, housing 159 has a larger inner diameter than drill pipe 37, defining a recess 161 for sleeve 101. In that embodiment, the inner diameter of sleeve 101 is the same as drill pipe 37. Recess 161 has an upper end and a lower end as shown in FIG. 4.

In this embodiment, sleeve 167 may have shear screws or pins 173 at a downstream end 175 that protrude inward to engage a groove 177 formed on an orifice ring 179 located within sleeve 167. Orifice ring 179 has a centrally located orifice 181 through which fluid can pass when not obstructed. The diameter of orifice 181 is smaller than the inner diameter of drill pipe 37. Orifice ring 179 may have a partially spherical profile 183 of a "drop ball" on its lower end and a tapered shoulder 185 at an upper end. Shear screws 173 have an appropriate shear value that when sheared release orifice ring 179 from sleeve 167 to allow drop ball profile 183 to manipulate downstream equipment. In this embodiment, a spring element 187 can be seated on an upward facing shoulder 189 of the housing 159 to support a lower end 175 of sleeve 167 and return sleeve 167 and to a closed position under less than minimum flow conditions, as shown in FIG. 11. When sufficient fluid flow exists within the drill string, the pressure acting on orifice ring 179 will compress spring element 187 to at least partially align ports 171 of sleeve 167 with ports 165 of housing 159, thereby metering fluid flow outward from the inner string 27 to the annular space. After orifice ring 179 has sheared and moved below valve 48, spring 187 will return sleeve 101 to the closed position. Because the inner diameter of sleeve 167 is the same as drill pipe 37, it does not provide a reduced diameter orifice that would result in a downward force on sleeve 167. Compression of spring element 187 and thus downward movement of sleeve 167 is limited by a stop shoulder 191 formed on inner profile 163 of housing 159. Stop shoulder 191 may contact downstream end 175 of sleeve 167 at higher flow conditions. Valve 48 maintains a minimum flow rate down drill pipe 37 because it is flow dependent and thus restrictions downstream do not affect the metered flow. Further, a plurality of valves 48 may be located at different points along the drilling assembly to stage flow into the annular area.

Figure 13:
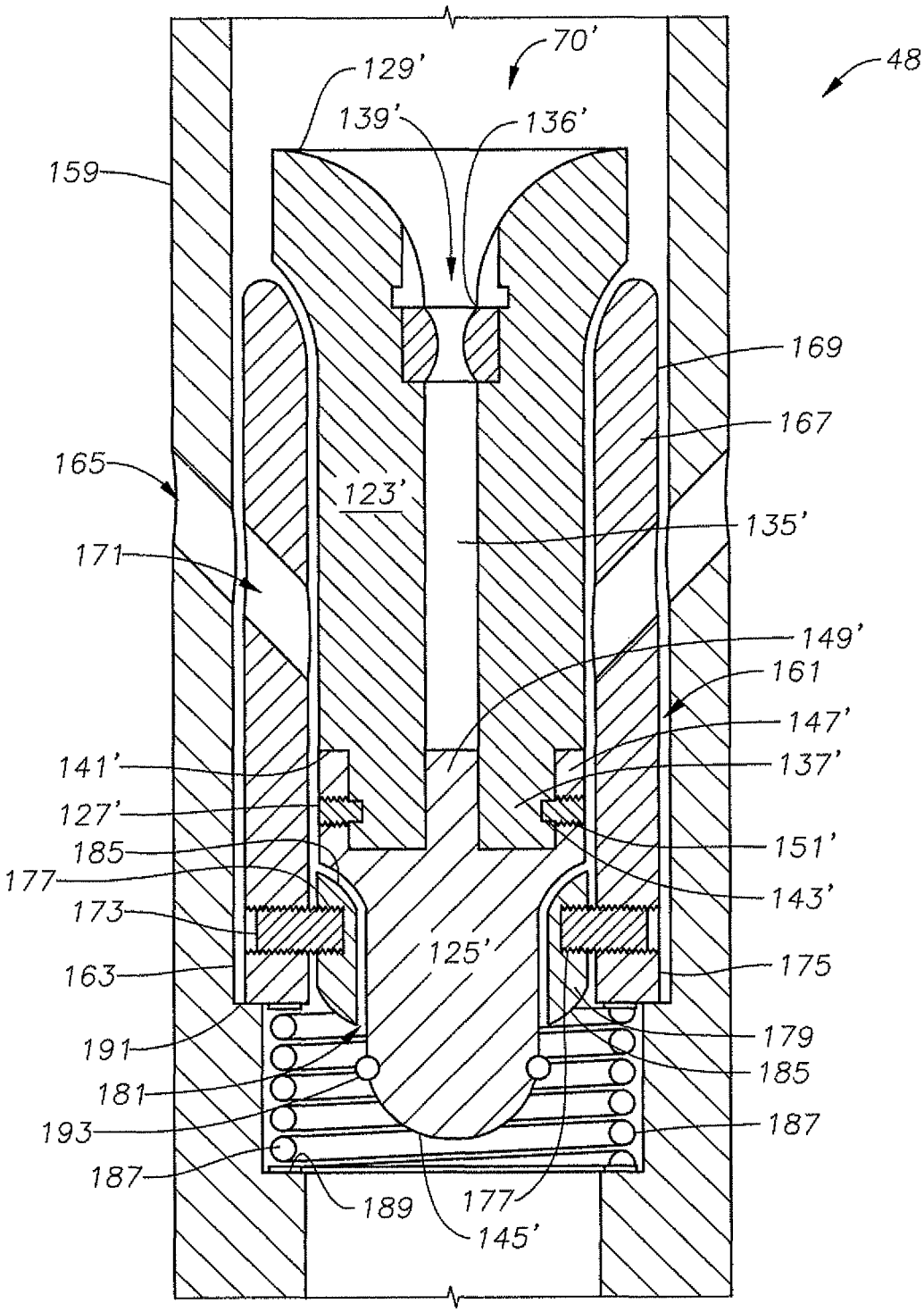
FIG. 13 is a partial sectional view of the diverter valve of FIG. 11 shown in operation with an alternate dampered drop plug of FIG. 10.

Referring to FIG. 13, a dampered drop plug 70' is shown that may be dropped into the inner string 27 and landed on orifice ring 179. Dampered drop plug 70' comprises a modified dampered drop plug 70 comprising the elements of dampered drop plug 70 as indicated by the prime notation. Retainer 123 has been modified as retainer 123' wherein upset 129' now comprises a curved upper annular portion of retainer 123' configured to land on sleeve 167. In addition, convex shaped lower portion 145' of plug 125' comprises only a partial ball shape. The profile of convex shaped lower portion 145' is configured to complete the convex shaped profile of orifice ring 179. A circlip 193 may be located in a groove of ball shaped lower portion 145' of plug 125' that prevents orifice ring 179 and plug 125' from becoming separated when moving downstream.

Generally, dampered drop plug 70' operates as described above with respect to dampered drop plug 70. In the illustrated embodiment, dampered drop plug 70' drops to the location shown on diverter valve 48 in the open position of FIG. 12 closing ports 165, 171. Shear screws 127' and 173 are then loaded and sheared such that the combined orifice ring 179 and plug 125' will drop as a unit to a ball seat, such as seat 103 (FIG. 4) or sleeve 69 (FIG. 3) which may now couple by means of shear pins, allowing for further operation of downhole tools. Alternatively, when dampered drop plug 70' lands on sleeve 167, a gap may exist between plug 125' and orifice ring 179. In the alternative embodiment, shear screws 127' will load and shear as described above with respect to dampered drop plug 70, allowing plug 125' to drop to orifice ring 179. Additional loading will then cause shear of shear screws 173, dropping plug 125' and orifice ring 179 as a single unit. As described above with respect to FIG. 10, following shear of shear screws 127', bit jet 136' will control the flow of fluid passing through retainer 123', thereby preventing premature shear of downhole elements such as orifice ring 179.

Accordingly, the disclosed embodiments provide numerous advantages over prior drop ball tool actuation systems. For example, the disclosed embodiments herein allow for use of a drop ball actuation system that can activate more than one function within a drill string. In addition, the disclosed embodiments provide a drop ball actuation system that dampens water hammer effects in the drill string, preventing premature shear of secondary shear seats. Furthermore, the drop ball actuation system of the disclosed embodiments provide primary components that are reusable. For example, plug 125 and retainer 123 may be removed from the running tool and reassembled for reuse using new shear screws 127.

While the invention has been shown or described in only some of its forms, it should be apparent to those skilled in the art that it is not so limited, but is susceptible to various changes without departing from the scope of the invention.

What is claimed is:

1. A downhole tool for actuating a first and a second function while dampening a water hammer effect comprises:

a tubular mandrel having an inner passage and an upper end that secures to a string of conduit to receive a flow of fluid;

an outer sleeve sealingly surrounding and axially movable relative to the mandrel, defining an annulus between the outer sleeve and the mandrel;

a piston between the mandrel and the outer sleeve, defining upper and lower chambers in the annulus;

an upper fluid port between the inner passage of the mandrel and the upper chamber;

a lower fluid port between the inner passage of the mandrel and the lower chamber;

the chambers having piston areas configured such that pressurized fluid flow from the inner passage simultaneously into both of the ports causes a net axial force on the outer sleeve to move the outer sleeve and an engaging member in a first axial direction to actuate the first function, and pressurized fluid flow through only the upper fluid port causes a net axial force on the outer sleeve to move the outer sleeve and the engaging member in a second axial direction to actuate the second function;

a dampered drop plug having a plug releasably coupled to a retainer and configured to be dropped downhole from a surface and through the string, the dampered drop plug controlling a fluid flowrate through the inner passage following actuation of the second function; and a seat in the inner passage between the upper and lower fluid ports, configured so that when the dampered drop plug lands on the seat, the dampered drop plug interrupts communication of the pressurized fluid flow with the lower chamber, and allows communication of the pressurized fluid flow with the upper chamber, wherein the seat is affixed in the inner passage such that the seat defines an upward facing shoulder to receive a downward facing shoulder of the dampered drop plug, wherein the retainer has an annular upset extending from an upper portion thereof, the upset defining the downward facing shoulder configured to land on and abut the upward facing shoulder of the seat; the retainer further controls the fluid flowrate through the inner passage, and wherein the plug couples to the retainer while at a first pressure in the inner passage and decouples from the retainer at a second pressure in the inner passage.

2. The downhole tool of claim 1, wherein the retainer further comprises a bit jet coupled to an inner diameter of the retainer at least partially within the inner passage to variably pass fluid from the inner passage axially above the retainer to the inner passage axially below the retainer at a controlled fluid flowrate.

3. The downhole tool of claim 1, wherein the plug couples to the retainer with shear screws configured to shear at the second pressure.

4. The downhole tool of claim 1, wherein the plug comprises a ball shaped lower end configured to land on a ball seat.

5. A method for actuating two functions with a dampered drop plug while dampening a water hammer effect, the method comprising:

(a) releasing a dampered drop plug into a drill string, the dampered drop plug having a plug and a retainer, wherein the plug is coupled to the retainer when the dampered drop plug is released into the drill string;

(b) the dampered drop plug actuating a first function;

(c) uncoupling the plug of the dampered drop plug from the retainer by raising a pressure above the dampered drop plug above a predetermined pressure;

(d) the retainer of the dampered drop plug dampening a water hammer; then (e) the plug of the dampered drop plug actuating a second function.

6. The method of claim 5, wherein step (a) comprises pumping the dampered drop plug into contact with an upward facing shoulder of a sleeve coupled to a first hydraulically activated tool coupled to the drill string.

7. The method of claim 5, wherein step (b) comprises raising the fluid pressure in a central bore of the drill string blocked by the dampered drop plug to actuate a first hydraulically actuated tool coupled to the drill string.

8. The method of claim 5, wherein step (c) comprises shearing a shear element coupling the plug of the dampered drop plug to the retainer of the dampered drop plug.

9. The method of claim 5, wherein the retainer comprises a bit jet nozzle coupled to an inner diameter of the retainer, step (d) comprising passing fluid axially above the retainer of the dampered drop plug through the bit jet nozzle at a specified rate.

10. The method of claim 5, wherein step (e) comprises:

pumping the plug into contact with a ball seat; and raising a fluid pressure within a central bore of the drill string blocked by the plug to actuate a second hydraulically actuated tool coupled to the drill string.

* * * * *